US006170500B1

(12) United States Patent
Turechek

(10) Patent No.: US 6,170,500 B1
(45) Date of Patent: Jan. 9, 2001

(54) RETRIEVABLE CANE

(76) Inventor: Gene D. Turechek, 313 Mustang Dr., Loveland, CO (US) 80537

( * ) Notice: Under 35 U.S.C. 154(b), the term of this patent shall be extended for 0 days.

(21) Appl. No.: 09/259,534

(22) Filed: Mar. 1, 1999

Related U.S. Application Data

(60) Provisional application No. 60/080,139, filed on Mar. 31, 1998.

(51) Int. Cl.[7] ..... A45B 3/00

(52) U.S. Cl. ..... 135/66; 165/65; 165/70; 165/72; 165/911; 248/155

(58) Field of Search ..... 135/66, 65, 911, 135/72, 80, 70; 248/155, 155.1, 155.3; 280/810, 816, 819, 821; 224/200, 221, 251, 206; 119/796, 712

(56) References Cited

U.S. PATENT DOCUMENTS 3,738,674 * 6/1973 Pauls ..... 280/819
3,963,037 * 6/1976 Clark ..... 135/911 X
3,964,441 * 6/1976 Wall ..... 119/796
4,182,272 * 1/1980 Taff ..... 119/796
4,365,808 * 12/1982 Perez ..... 135/66 X
4,593,933 * 6/1986 Nunno ..... 280/820 X
4,884,730 * 12/1989 Carpenter ..... 135/66 X

* cited by examiner

*Primary Examiner*—Carl D. Friedman
*Assistant Examiner*—Winnie Yip
(74) *Attorney, Agent, or Firm*—Ancel W. Lewis, Jr.

(57) ABSTRACT

A retrievable cane disclosed includes a cane body to which there is attached a retrieval line that is anchored at a lower end and extends from the inside of the cane body at the lower end up through the cane body out through the rear of the cane body below the grip. The retrieval line has an elastic section that allows an attachment end outside the cane body to be releasably attached to the body of the user preferably having the grip portion at the waist allowing normal walking by the user. The elastic section allows the user to pull the cane body away from the waist for use during walking and the elastic section automatically returns the cane to the user's waist when released.

23 Claims, 2 Drawing Sheets

RETRIEVABLE CANE

This application claims the benefit under 35 U.S.C. §119(e) of the U.S. provisional patent application No. 60/080,139 filed Mar. 31, 1998.

TECHNICAL FIELD

This invention relates to walking canes and more particularly to a combined walking cane and a retrieval device that enables the cane to be attached to the user's body preferably at the waist for readily retrieving the cane.

BACKGROUND ART

Canes frequently become misplaced by the user. This may result from memory disorders or in some cases people lack strength, physical flexibility, dexterity, vision and the like. If these people drop the cane many time there is great difficulty in retrieving the cane. Also, it is an advantage to have the cane ready for use while at the same time allowing mobility and the use of both hands by the cane user.

Wading fishermen encounter irregular surfaces, slippery rocks or fast water so a cane would stabilize the fisherman. A cane according to the present invention can be used for moving through the stream and then return to the waist of the user while fishing allowing the use of both hands for fishing.

DISCLOSURE OF THE INVENTION

A retrievable cane disclosed includes an elongated hollow cane body and a retrieval device attached to the cane body. The retrieval device includes a retrieving line having an elastic line section in the body having a lower end anchored at the lower end of the cane body. A user attachment upper end of the retrieval line has a connecting member outside the body. The retrieval line extends through an aperture in the top portion of the body such that when the connecting member is attached to the body of the user preferably at the waist the cane body may be moved away from the user by applying a force to the retrieving line to stretch the elastic line section during use of the cane and will contract the user attachment upper end back to its original position so as to be readily carried by the body of the user during walking when not used as a cane.

BRIEF DESCRIPTION OF THE DRAWINGS

Details of this invention are described in connection with the accompanying drawings which like parts bear similar reference numerals in which.

DETAILED DESCRIPTION

Figures 1, 2:
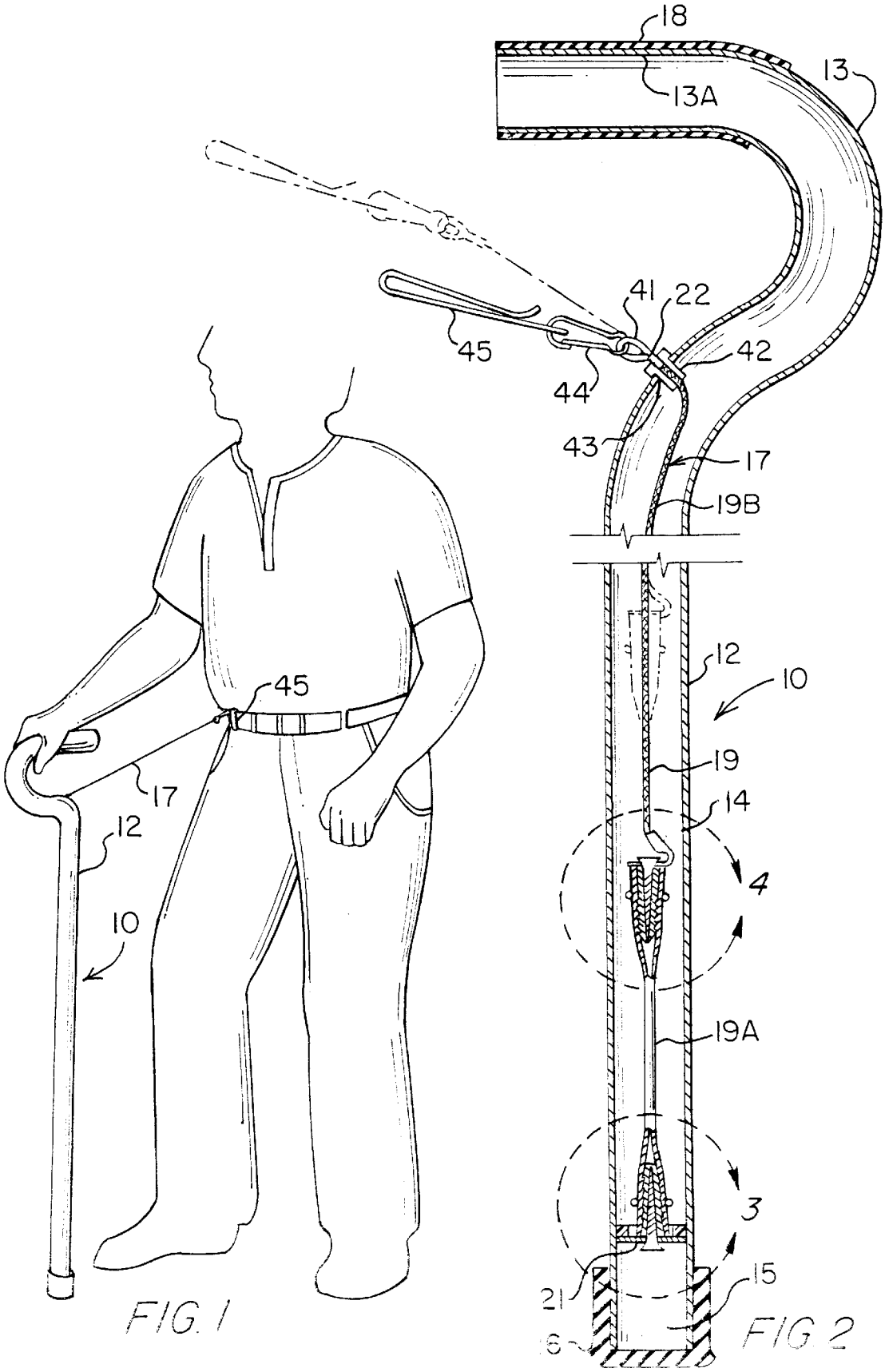
FIG. 1 is a perspective view of a retrievable cane shown attached to the belt of a user and in an extended position suitable for use of the cane for support during walking.
FIG. 2 is a vertical cross sectional view of the retrieval device shown in FIG. 1 with the retrieval device in a retracted position and with an extended position shown in dashed lines.

Referring now to FIGS. 1–4 there is shown a retrievable cane 10 embodying features of the present invention including an elongated, hollow cane body 12 preferably made of a one piece integral construction of a lightweight solid material such as aluminum, wood or molded plastic. The cane body 12 has a backward C-shaped grip portion 13 at the upper end of a straight elongated hollow stick portion 14 preferably of cylindrical shape initially made with an open lower end 15. The grip portion 13 bends out around and back in and has a non-slip layer 18 on a straight top end portion 13A. A cap 16 is shown closing the lower end of the tubing body.

A retrieval device 17 is attached to the cane body 12. The retrieval device 17 includes a retrieval line 19 attached at a lower end 21 inside the cane body 12 and extending upwardly through the cane body and out a rear side of an upper portion of the body below the grip portion 13 and having a user attachment upper end 22 outside the cane body 12. Generally stated, the retrieval line 19 includes a lower line section 19A made of an elastic material and an upper line section 19B made of a non-elastic material. Lower line section 19A is shown as a length of elastic tubing. Upper line section 19B is shown as a non-elastic fabric cord.

Figure 3:
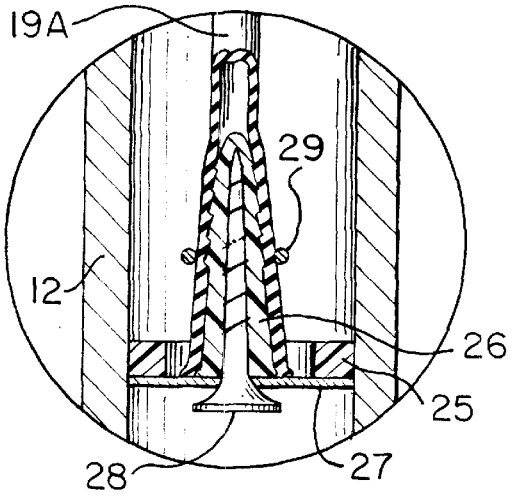
FIG. 3 is an enlarged cross sectional view of a portion of FIG. 2 identified in circular dashed lines by numeral 3.

As shown in FIG. 3 the means for attaching the retrieval line 19 at the lower end of and inside the cane body inwardly a selected distance from the lower open end 15 includes a split plastic anchor ring 25 that is affixed inside the cane body 12, preferably with an adhesive, a hollow, tapered expandable body.26 inside the lower end portion of the tubing 19A, a washer 27 against the bottom of the anchor ring 25, a screw 28 extending through the washer and threaded into the expandable body 26 to expand the body and enlarge the lower end portion of the tubing and a ring 29 embraces enlarged end portion of the tubing that fits over the expandable body 26 to inhibit the tubing from sliding off the body 26. The expandable body 26 shown is a plastic dry wall anchor.

Figure 4:
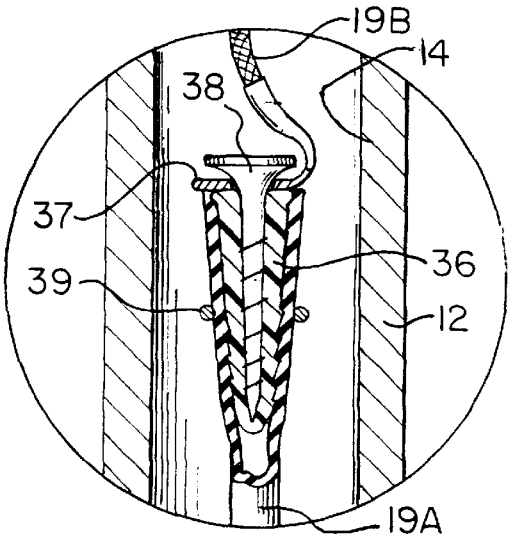
FIG. 4 is an enlarged cross sectional view of a portion of FIG. 2 identified in circular dashed lines by numeral 4.

As shown in FIG. 4 the means for attaching the tubing 19A to the upper line section 19B includes a hollow, tapered expandable body 36 inside an upper end portion of the tubing 19A that expands the tubing, a bent first eyelet 37 over the top end of the expandable body 36, a screw 38 extending through the eyelet 37 and expanding the expandable body 36. The bent first eyelet 37 is secured at the upper end of cord 19A, and a ring 39 embraces the expanded tubing to hold the tubing to the body 36. The tubing 19A shown found suitable is a length of latex rubber tubing. The elastic line section or tubing 19A has a low spring constant and provides the extension necessary to allow the cane body to be pulled away from the user's waist and used in a normal fashion with little effort and yet automatically return the cane to the waist upon release by the hand.

This tubing is a product of Kent Latex Products, a division of Meridian Industries, Inc. This tubing has natural latex physical properties as follows:

| | |
|---|---|
| Tensile | 3,500 PSI Min. |
| Elongation at Break | 750% Min. |
| Modulus at 300% | 190 PSI Max. |

-continued

| | |
|---|---|
| Shore A Durometer Hardness | 35 ± 5 |
| Specific Gravity | 0.95 |

The cord 19B extends through a sleeve or bushing 42 having external threads shown threaded into an aperture 43 in the back or rear side of the cane body below the grip portion 13 and has a hook 44 fastened to the second eyelet 41 at the upper end of cord 19B with a belt clip 45 fastened to the hook. The bushing 42 preferably has a smooth inner throughbore and is made of stainless steel.

The above described retrieval device 19 is readily adapted to be attached to any hollow cane. The procedure for attaching the above described retrieval device 19 to a cane body 12 is as follows:

1. Drill aperture 43 in the back of the cane below the grip portion and thread bushing 42 into aperture 43.
2. Put an adhesive on the inside surface of the can body 12 and slide split anchor ring 25 through the open end 15 a selected distance up into the cane body from the lower open end 15. This distance preferably is six inches. The length of the cane from the top to the split ring is preferably 32 inches.
3. A length of the cord 19B on a roll is threaded down through the bushing 42 down through the cane body and out the open end 15 of the cane body.
4. The elastic section 19A is assembled outside the cane body 12. The bottom portion is done first by cutting a length of tubing such as five inches, inserting the expandable anchor 26 into the lower end of the tubing, putting the ring 29 around the tubing, setting the washer 27 on top of the expandable body 26, and threading the screw 28 into the expandable body 26 to expand the expandable body so as to lock the rubber tubing in place. The upper section 19B is then assembled by placing the lock ring 39 around the tubing and inserting the expandable body 32 into the upper end of the tubing. The eyelet 37 is attached to the cord 19B and then bent at a right angle. The screw 38 is put through the eyelet 37 and into the expandable body 36.
5. The assembly then is pulled up through the cane body by pulling on the cord until the assembly is taught. The top eyelet 41 is attached to the top end of the cord 19B. The tension is set by adjusting the length of the cord so that the cane will hold against the belt under the weight of the cane.
6. The hook 44 and the belt clip 45 are then attached.

In use, the belt clip 45 is clipped onto the belt of the user and when a force is applied to the user attachment upper end the elastic line section 19A will expand to allow the cane to move out to a walking position and will automatically move back and be held by the belt when the user releases the cane body. Other attachments to the user at the waist may include a belt, chain, clothing loop, waistband, sash and the like.

Figure 5:
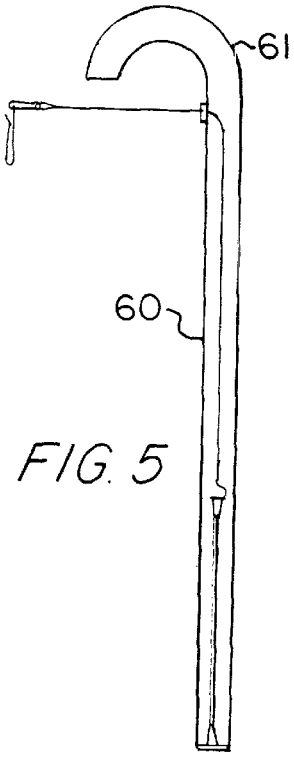
FIG. 5 is an alternative embodiment showing an inverted U-shaped grip.
Figure 6:
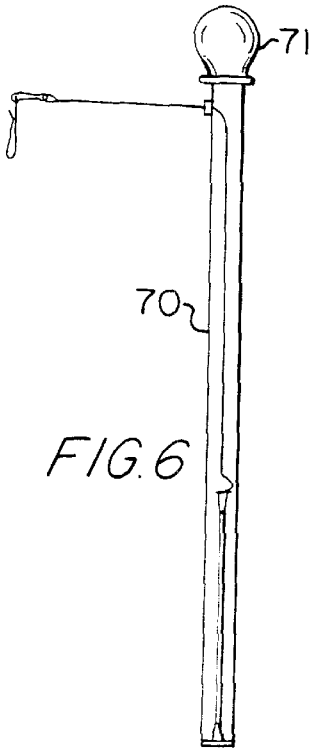
FIG. 6 is an alternative embodiment showing a ball-shaped grip.
Figure 7:
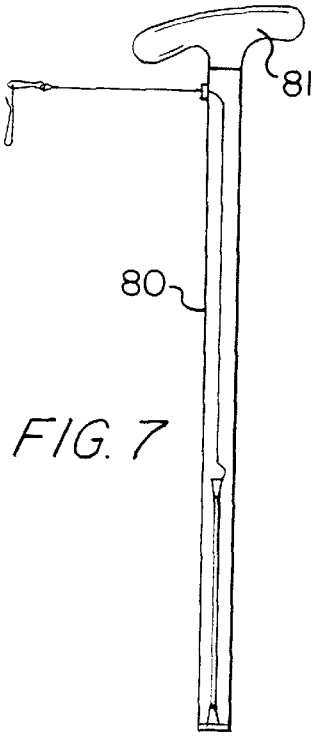
FIG. 7 is an alternative embodiment showing a T-shaped grip.

FIG. 5 shows a retrievable cane 60 having an inverted U-shaped grip portion 61. FIG. 6 shows a retrievable cane 70 with a ball-shaped grip portion 71. FIG. 7 shows a retrievable cane 80 with a T-shaped grip portion 81. Another grip portion suitable is in the shape of the number seven ("7").

Figure 8:
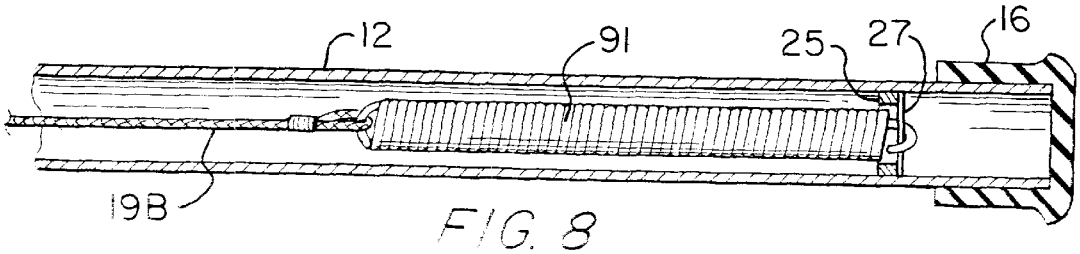
FIG. 8 is a cross-sectional view of an alternative embodiment showing a coil spring instead of an elastic tube.

Referring now to FIG. 8 there is shown an alternative embodiment using a coil spring 91 with a low spring constant in place of the elastic tubing 19A. Spring 91 is held by the anchor ring 25 and washer 27 at the lower end and attaches to the cord 19B at the upper end of the spring 91. Another suitable elastic line section could be made of a bungee cord.

Although the present invention has been described with a certain degree of particularity, it is understood that the present disclosure has been made by way of example and that changes in details of structure may be made without departing from the spirit thereof.

What is claimed is:

1. A retrievable cane comprising:

an elongated hollow cane body having a grip portion at an upper end, and a retrieval device attached to said cane body, said retrieval device including a retrieval line attached at a lower end inside said body, said line extending through a rear wall of said body below said grip portion and having a user attachment end outside said body for attachment at the side of the user, said retrieval line having an at rest position wherein said user attachment end is adjacent to said body, said line being extensible to an extended position to enable said attachment end to extend to a selected distance from said body whereby said grip portion is grasped by the user during walking, said retrieval line having return means attached at said lower end to apply a return force to return said body toward the side of the user and place said grip under tension during use and to automatically move said user attachment end from the extended position to said at rest position when the user releases said body.

2. A cane as set forth in claim 1 wherein said return means includes an elongated elastic line section of latex rubber tubing.

3. A cane as set forth in claim 1 wherein said return means includes a coil spring.

4. A cane as set forth in claim 1 wherein said body has a straight cylindrical stick portion having said grip portion at said upper end.

5. A cane as set forth in claim 1 wherein said body is aluminum.

6. A cane as set forth in claim 1 wherein said body is plastic.

7. A cane as set forth in claim 1 wherein said retrieval line includes an upper section made of an inelastic cord.

8. A cane as set forth in claim 7 including a hollow bushing in an aperture in said body through which said cord slides provide an exit guide for said retrieval line.

9. A cane as set forth in claim 8 wherein said bushing is hardened steel.

10. A cane as set forth in claim 1 including an attachment device at said attachment end.

11. A cane as set forth in claim 10 wherein said attachment device includes a belt clip.

12. A cane as set forth in claim 10 wherein said attachment device includes a snap hook.

13. A retrievable cane comprising:

an elongated hollow cane body having a grip portion at an upper end, and a retrieval device attached to said body, said retrieval device including an extensible and retractable retrieval line attached at a lower end inside said having an elastic return means body and extending through an aperture in a rear wall of said body below said grip portion and terminating in a user attachment end disposed outside of said body for attachment at the side of the user whereby when said attachment end is attached to a user, said body at the waist may be moved from an at rest position away from the body of the user by applying a force to said retrieval line to stretch said elastic return means in said retrieval line and remain attached to the user to an extended position allowing use of the cane during walking, said return means applying a return force to return said body toward the side of the user and place said grip under tension during use and automatically retract back to the at rest position to return said body to the user upon release of said body by the user.

14. A cane as set forth in claim 13 wherein said elastic return means is a length of latex rubber tubing.

15. A cane as set forth in claim 13 wherein said elastic return means is a coil spring.

16. A cane as set forth in claim 13 wherein said retrieval line includes an upper section of a non-elastic cord having a first eyelet at said attachment end and a second eyelet at a lower end.

17. A retrievable cane comprising:

an elongated hollow cane body having a grip portion at an upper end, and a retrieval device attached to said cane body, said retrieval device including a retrieval line attached at a lower end inside said body, said line extending through a rear wall of said cane body below said grip portion having a user attachment end outside said body, said retrieval line having an at rest position wherein said user attachment end is adjacent to said body, said line being extensible to an extended position to enable said attachment end to extend to a selected distance from said body whereby said grip portion is grasped by the user during walking, said retrieval line having return means to automatically move said user attachment end from the extended position to said at rest position when the user releases said body, a lower end of said body being open, an anchor ring fitted in said body inwardly of said open lower end to which a lower end of said return means is attached, a cap closing said open lower end of said body.

18. A cane as set forth in claim 17 wherein said grip portion is backward C-shaped.

19. A cane as set forth in claim 17 wherein said grip portion is inverted U-shaped.

20. A cane as set forth in claim 17 wherein said grip portion is T-shaped.

21. A cane as set forth in claim 17 wherein said grip portion is ball-shaped.

22. A retrievable cane comprising:

an elongated hollow cane body having a grip portion at an upper end, and a retrieval device attached to said body, said retrieval device including an extensible and retractable retrieval line having an elastics return means attached at a lower end inside said body and extending through an aperture in an upper portion of said body and terminating in a user attachment end disposed outside of said body whereby when said attachment end is attached to a user said body at the waist may be moved from an at rest position away from the body of the user by applying a force to said retrieval line to stretch said elastic return means in said retrieval line and remain attached to the user to an extended position allowing use of the cane during walking and automatically retract back to the at rest position to return said body to the user upon release of said body by the user, said retrieval line including an upper section of a non-elastic cord having a first eyelet at said attachment end and a second eyelet at a lower end, said elastic return means being in the form of a length of tubing connected to the lower end of said upper section, and means for attaching said tubing to a lower end of said body, said means for attaching including:

an anchor ring affixed to the inside of said body, an expandable body inside a lower end portion of said tubing, a washer against said ring, a screw extending through said washer and into said expandable body to expand said body and said tubing, and a ring embracing said tubing around said expandable body.

23. A retrievable cane comprising:

an elongated hollow cane body having a grip portion at an upper end, and a retrieval device attached to said body, said retrieval device including an extensible and retractable retrieval line having an elastic return means attached at a lower end inside said body and extending through an aperture in an upper portion of said body and terminating in a user attachment end disposed outside of said body whereby when said attachment end is attached to a user said body at the waist may be moved from an at rest position away from the body of the user by applying a force to said retrieval line to stretch said elastic return means in said retrieval line and remain attached to the user to an extended position allowing use of the cane during walking and automatically retract back to the at rest position to return said body to the user upon release of said body by the user, said retrieval line including an upper section of a non-elastic cord having a first eyelet at said attachment end and a second eyelet at a lower end, said elastic return means being in the form of a length of tubing connected to the lower end of said upper section, and means for attaching said tubing to an upper non-elastic cord including an expandable body inside an upper end portion of said tubing, a washer over the top end of said expandable body, a screw extending through said washer and expandable body and a second eyelet, and a ring embracing said tubing on said expandable body.

* * * * *